US011501915B2

(12) United States Patent
Bong et al.

(10) Patent No.: US 11,501,915 B2
(45) Date of Patent: Nov. 15, 2022

(54) COIL COMPONENT AND METHOD OF MANUFACTURING THE SAME

(71) Applicant: SAMSUNG ELECTRO-MECHANICS CO., LTD., Suwon-si (KR)

(72) Inventors: Kang Wook Bong, Suwon-Si (KR); Byeong Cheol Moon, Suwon-Si (KR); Boum Seock Kim, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 682 days.

(21) Appl. No.: 16/191,419

(22) Filed: Nov. 14, 2018

(65) Prior Publication Data

US 2019/0326055 A1 Oct. 24, 2019

(30) Foreign Application Priority Data

Apr. 19, 2018 (KR) ..... 10-2018-0045691

(51) Int. Cl.
*H01F 27/28* (2006.01)
*H01F 41/04* (2006.01)
(Continued)

(52) U.S. Cl.
CPC ..... *H01F 41/042* (2013.01); *H01F 27/24* (2013.01); *H01F 27/2804* (2013.01);
(Continued)

(58) Field of Classification Search
CPC .. H01F 17/0006; H01F 17/0013; H01F 27/24; H01F 27/29; H01F 27/292;
(Continued)

(56) References Cited

U.S. PATENT DOCUMENTS 5,515,022 A * 5/1996 Tashiro ..... H01F 17/0013 174/262
5,647,966 A * 7/1997 Uriu ..... H05K 3/205 156/89.12
(Continued)

FOREIGN PATENT DOCUMENTS

CN 105280336 A 1/2016
CN 105428034 A 3/2016
(Continued)

OTHER PUBLICATIONS

Chinese Office Action dated Jan. 6, 2021 issued in Chinese Patent Application No. 201910052830.1 (with English translation).
(Continued)

*Primary Examiner* — Tszfung J Chan
(74) *Attorney, Agent, or Firm* — Morgan, Lewis & Bockius LLP

(57) ABSTRACT

There are provided a coil component and a method of manufacturing the same. The coil component includes: a body portion including a magnetic material; a coil portion disposed in the body portion; and an electrode portion disposed on the body portion, wherein the coil portion includes a support member having groove portions formed in at least one surface thereof and a coil conductor layer filling the groove portions and protruding onto the at least one surface of the support member, the groove portions having planar spiral shapes.

17 Claims, 7 Drawing Sheets

(51) Int. Cl.
*H01F 27/29* (2006.01)
*H01F 27/24* (2006.01)
*H01F 27/32* (2006.01)
*H01F 41/12* (2006.01)

(52) U.S. Cl.
CPC ..... *H01F 27/29* (2013.01); *H01F 27/32* (2013.01); *H01F 41/12* (2013.01); *H01F 2027/2809* (2013.01)

(58) Field of Classification Search
CPC .... H01F 27/32; H01F 27/323; H01F 27/2804; H01F 2017/002; H01F 2027/2809; H01F 2027/2819; H01F 5/003
USPC ..... 336/200, 232
See application file for complete search history.

(56) References Cited

U.S. PATENT DOCUMENTS 7,135,951 B1* 11/2006 Sidhu ..... H01F 17/0013 336/200
2008/0048289 A1* 2/2008 Lee ..... H01L 28/10 257/E21.022
2008/0100408 A1* 5/2008 Chen ..... H01L 23/5227 336/200
2013/0038417 A1* 2/2013 Kim ..... H01F 17/0013 336/192
2013/0249664 A1* 9/2013 Tonoyama ..... H01F 27/255 336/200
2015/0173197 A1* 6/2015 Cho ..... H01F 41/046 361/748
2015/0294789 A1 10/2015 Sano et al.
2016/0126004 A1* 5/2016 Yang ..... H01F 27/292 336/90
2016/0189852 A1* 6/2016 Jeon ..... H01F 27/292 336/192
2017/0032884 A1 2/2017 Choi et al.
2017/0178789 A1 6/2017 Kim et al.
2017/0236633 A1 8/2017 Park et al.
2018/0308612 A1* 10/2018 Park ..... H01F 5/04
2018/0342342 A1* 11/2018 Taniguchi ..... H01F 41/041
2018/0374626 A1 12/2018 Jang

FOREIGN PATENT DOCUMENTS

CN 106128719 A 11/2016
CN 106409469 A 2/2017
CN 109119233 A 1/2019
EP 0185770 A1 7/1986
JP H01-256107 A 10/1989
JP 2004-111597 A 4/2004
JP 2004111597 A * 4/2004
JP 5294288 B1 9/2013
KR 10-2000-0020823 A 4/2000
KR 20090064660 A * 6/2009
KR 10-2016-0018382 A 2/2016
KR 10-2017-0073167 A 6/2017
WO WO-2015008316 A1 * 1/2015 ..... H01F 41/046

OTHER PUBLICATIONS

Office Action issued in corresponding Korean Application No. 10-2018-0045691, dated Apr. 30, 2019 (with English translation).

* cited by examiner

COIL COMPONENT AND METHOD OF MANUFACTURING THE SAME

CROSS-REFERENCE TO RELATED APPLICATION(S)

This application claims the benefit of priority to Korean Patent Application No. 10-2018-0045691 filed on Apr. 19, 2018, in the Korean Intellectual Property Office, the disclosure of which is incorporated herein by reference in its entirety.

TECHNICAL FIELD

The present disclosure relates to a coil component such as a power inductor.

BACKGROUND

An inductor, a coil component, is a representative passive element constituting an electronic circuit together with a resistor and a capacitor to remove noise. The inductor may be categorized as a thin film type inductor formed using plating, a multilayer inductor using paste printing, and a winding type inductor, formed using a winding coil.

Recently, in accordance with the miniaturization and thinning of electronic devices such as a digital television (TV), a mobile phone, a laptop computer, and the like, the miniaturization and increases in the inductance of coil components used in such electronic devices have been demanded. Therefore, in accordance with an effort to reduce a cost of a magnetic material, a multilayer power inductor has mainly been replaced with a thin film type power inductor and a winding type power inductor.

In a case of the thin film type inductor, in accordance with changes such as complexation, multifunctionalization, slimness of a product, an attempt to further decrease a thickness of the inductor has been continuously conducted. Therefore, a structure capable of securing high performance and reliability of the inductor in spite of the trend of the slimness of the inductor has been demanded.

SUMMARY

An aspect of the present disclosure may provide a coil component in which rigidity of a coil may be improved, an inductance may be sufficiently improved, and a high aspect ratio may be implemented, in spite of slimness of the coil component, and a method of manufacturing the same.

According to an aspect of the present disclosure, a coil component may be provided, in which a coil conductor layer is formed on a support member having groove portions formed in at least one surface thereof and having planar spiral shapes.

According to an aspect of the present disclosure, a coil component may include: a body portion including a magnetic material; a coil portion disposed in the body portion; and an electrode portion disposed on the body portion, wherein the coil portion includes a support member having groove portions formed in at least one surface thereof and a coil conductor layer filling the groove portions and protruding onto the at least one surface, the groove portions having planar spiral shapes.

According to another aspect of the present disclosure, a method of manufacturing a coil component may include: forming a coil portion; forming a body portion embedding the coil portion therein; and forming an electrode portion on the body portion, wherein the forming of the coil portion includes: forming groove portions having planar spiral shapes in at least one surface of a support member; forming a seed layer in the groove portions and on the at least one surface; and forming a conductor layer on the seed layer to form a coil conductor layer filling the groove portion and protruding onto the at least one surface.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
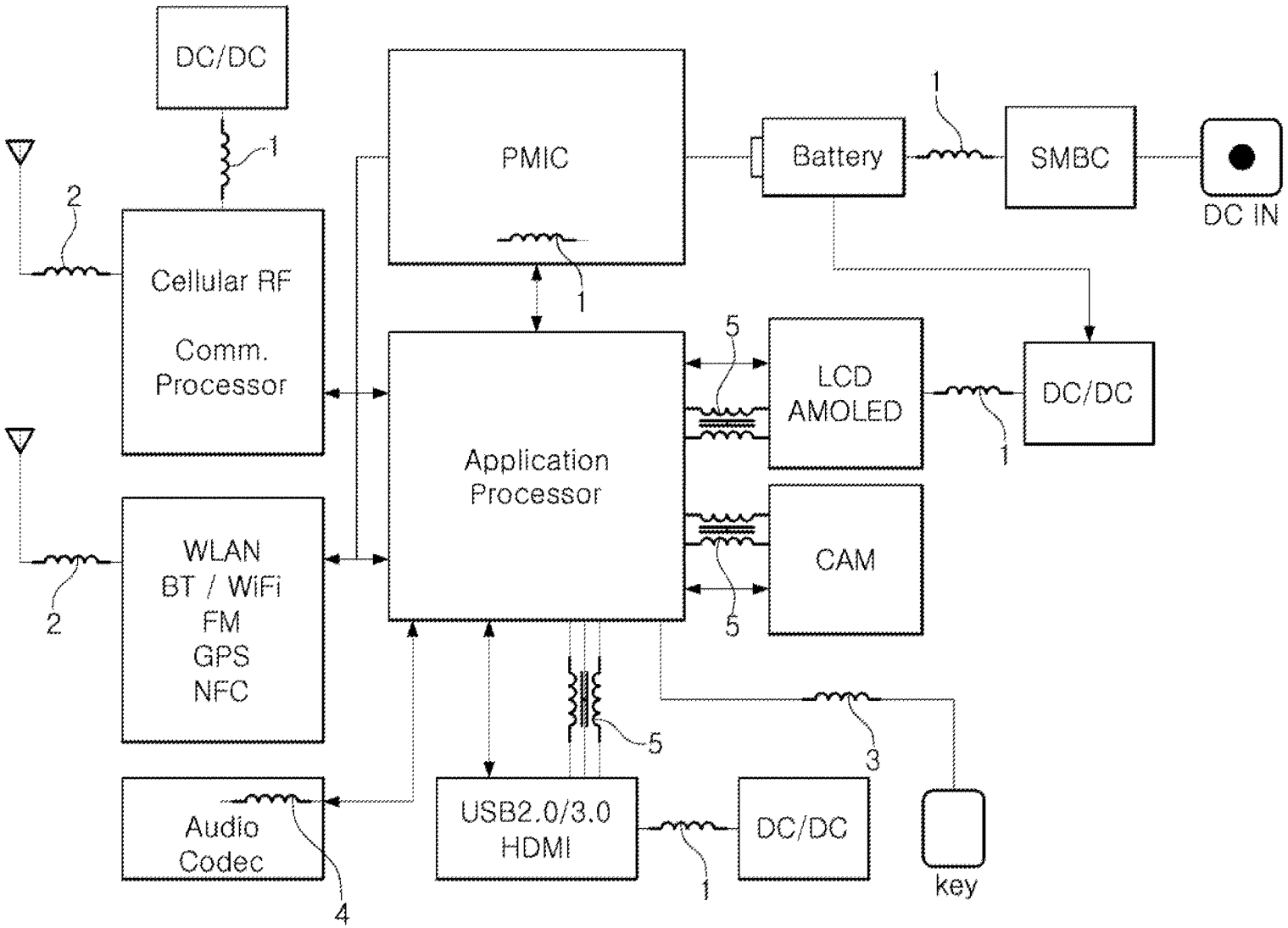
FIG. 1 is a schematic view illustrating an example of a coil component used in an electronic device.

Hereinafter, exemplary embodiments in the present disclosure will be described in more detail with reference to the accompanying drawings. In the drawings, shapes, sizes, and the like, of components may be exaggerated for clarity.

Meanwhile, herein, "electrically connected" conceptually includes a physical connection and a physical disconnection. It can be understood that when an element is referred to with terms such as "first" and "second", the element is not limited thereby. They may be used only for a purpose of distinguishing the element from the other elements, and may not limit the sequence or importance of the elements. In some cases, a first element may be referred to as a second element without departing from the scope of the claims set forth herein. Similarly, a second element may also be referred to as a first element.

In addition, the term "an exemplary embodiment" used herein does not refer to the same exemplary embodiment, and is provided to emphasize a particular feature or characteristic different from that of another exemplary embodiment. However, exemplary embodiments provided herein are considered to be able to be implemented by being combined in whole or in part one with one another. For example, one element described in a particular exemplary embodiment, even if it is not described in another exemplary embodiment, may be understood as a description related to another exemplary embodiment, unless an opposite or contradictory description is provided therein.

In addition, terms used herein are used only in order to describe an exemplary embodiment rather than limiting the present disclosure. In this case, singular forms include plural forms unless interpreted otherwise in context.

Electronic Device

FIG. 1 is a schematic view illustrating an example of a coil component used in an electronic device. Referring to FIG. 1, it may be appreciated that various kinds of electronic components are used in an electronic device. For example, an application processor, a direct current (DC) to DC converter, a communications processor (e.g., capable of processing communications using a wireless communication protocol such as wireless local area network Bluetooth (WLAN BT), wireless fidelity (WiFi), frequency modulation (FM), global positioning system (GPS), near field communications (NFC), etc.) a power management integrated circuit (PMIC), a battery, an SMBC, a liquid crystal display active matrix organic light emitting diode (LCD AMOLED) , an audio codec, a universal serial bus (USB) 2.0/3.0 a high definition multimedia interface (HDMI), a CAM, and the like, may be used. In this case, various kinds of coil components may be appropriately used in these electronic components depending on their purposes in order to remove noise, or the like. For example, a power inductor 1, high frequency (HF) inductors 2, a general bead 3, a bead 4 for a high frequency (GHz), common mode filters 5, and the like, may be used.

In more detail, the power inductor 1 may be used to store electricity in a magnetic field form to maintain an output voltage, thereby stabilizing power. In addition, the high frequency (HF) inductor 2 may be used to perform impedance matching to secure a required frequency or cut off noise and an alternating current (AC) component. Further, the general bead 3 may be used to remove noise of power and signal lines or remove a high frequency ripple. Further, the bead 4 for a high frequency (GHz) may be used to remove high frequency noise of a signal line and a power line related to an audio. Further, the common mode filter 5 may be used to pass a current therethrough in a differential mode and remove only common mode noise.

An electronic device may be typically a smartphone, but is not limited thereto. The electronic device may also be, for example, a personal digital assistant, a digital video camera, a digital still camera, a network system, a computer, a monitor, a television, a video game, a smartwatch, or an automobile . The electronic device may also be various other electronic devices well-known to those skilled in the art, in addition to the devices described above.

Coil Component

Hereinafter, a coil component according to the present disclosure, particularly, a power inductor will be described for convenience of explanation. However, the coil component according to the present disclosure may also be applied as the coil components for various purposes as described above.

Meanwhile, herein, a side portion refers to a direction toward a first direction or a second direction for convenience, an upper portion refers to a direction toward a third direction for convenience, and a lower portion refers to a direction toward an opposite direction to the third direction for convenience. In addition, a width direction refers to the first direction or the second direction, and a thickness direction refers to the third direction.

Meanwhile, a phrase "positioned at the side portion, the upper portion, or the lower portion" has been used as a concept including a case in which a target component is positioned in a corresponding direction, but does not directly contact a reference component, as well as a case in which the target component directly contacts the reference component in the corresponding direction. However, these directions are defined for convenience of explanation, and the claims are not particularly limited by the directions defined as described above.

Figure 2:
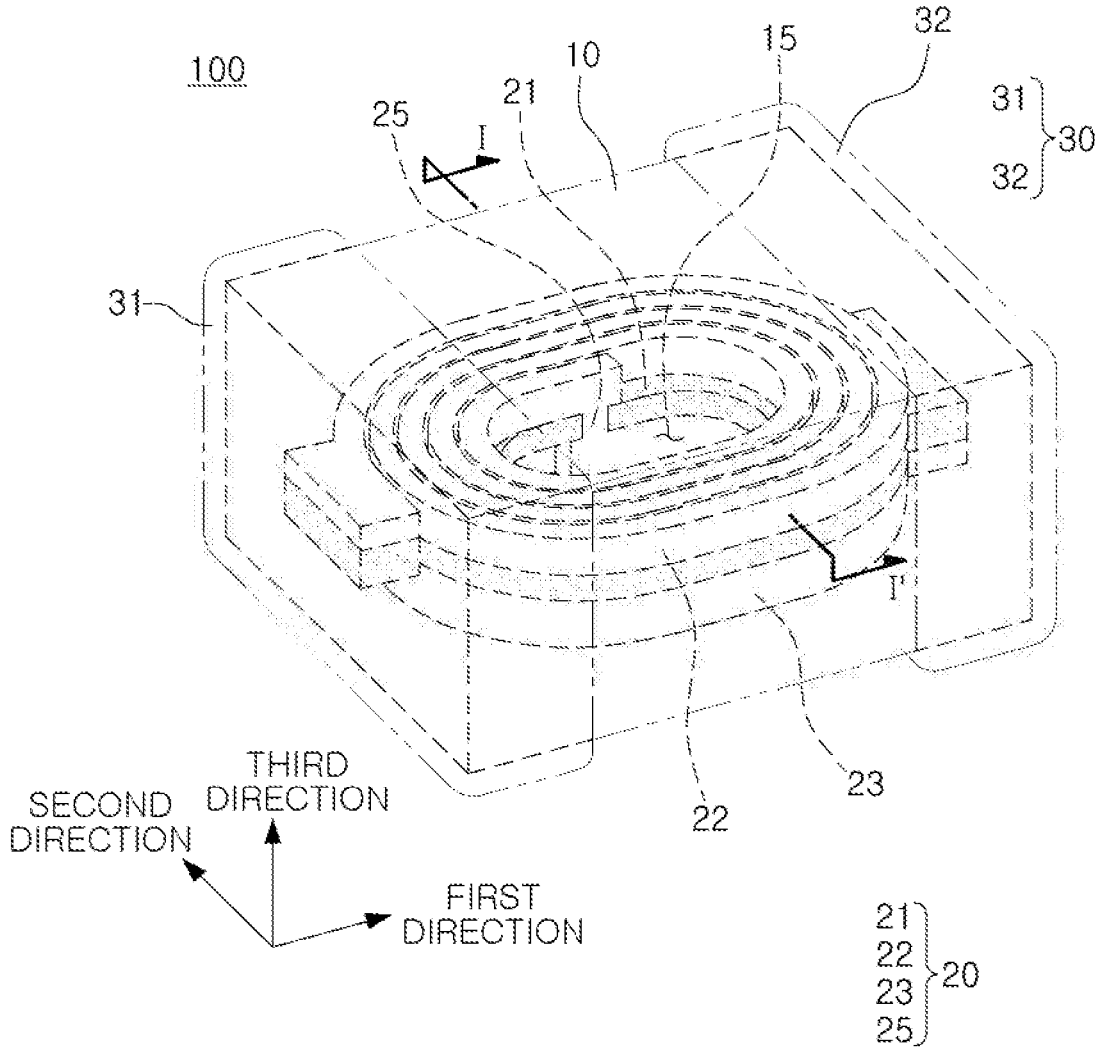
FIG. 2 is a schematic perspective view illustrating an example of a coil component.

FIG. 2 is a schematic perspective view illustrating an example of a coil component.

Figure 3:
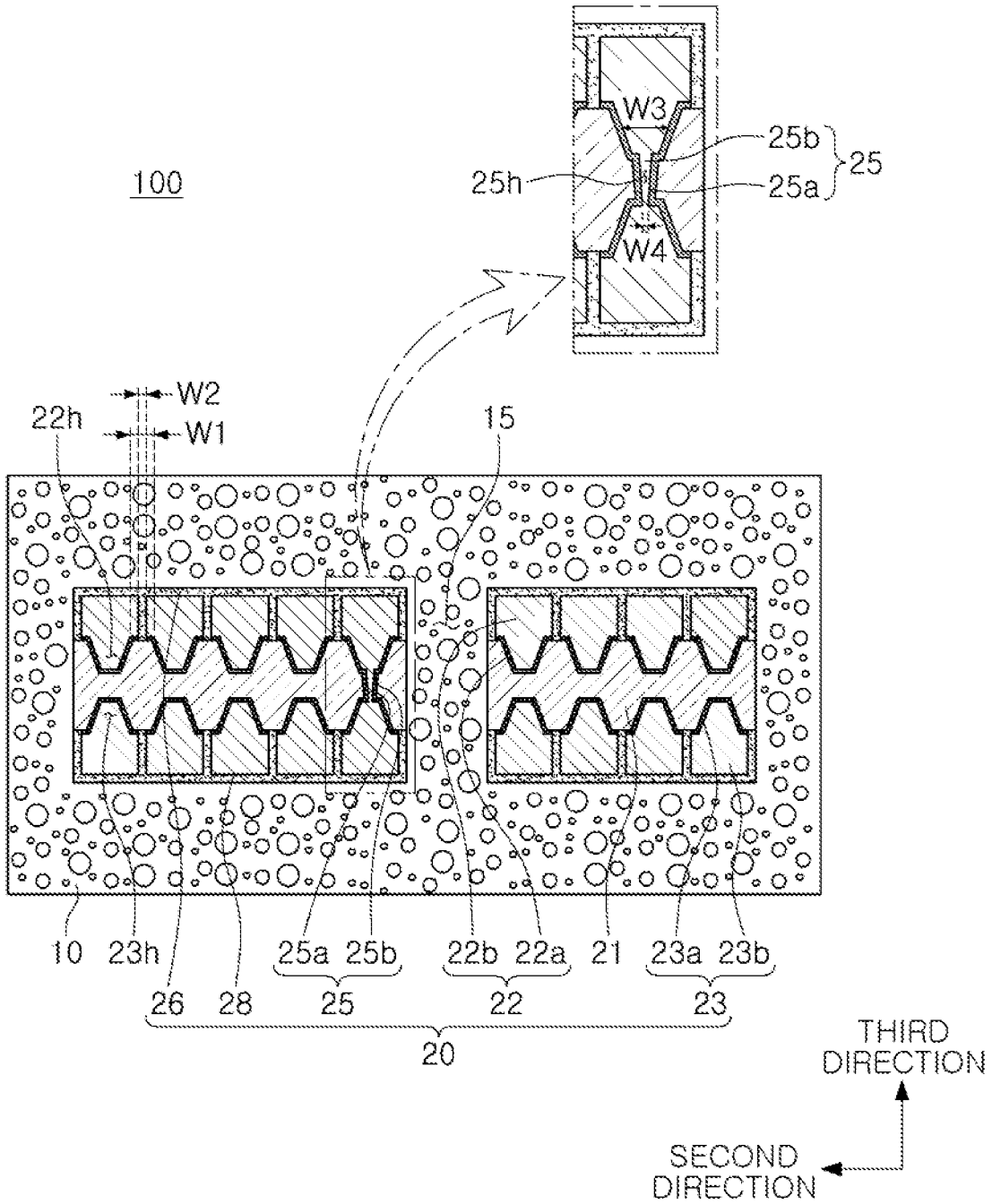
FIG. 3 is a schematic cross-sectional view taken along line I-I' of the coil component of FIG. 2.

FIG. 3 is a schematic cross-sectional view taken along line I-I' of the coil component of FIG. 2.

Referring to FIGS. 2 and 3, a coil component 100 according to an exemplary embodiment in the present disclosure may include a body portion 10, a coil portion 20 disposed in the body portion 10, and an electrode portion 30 disposed on the body portion 10. In this case, the coil portion 20 may include a support member 21. First and second groove portions **22*h* and 23*h* having first and second spiral shapes, respectively, may be formed in upper and lower surfaces of the support member 21, respectively. In addition, the coil portion 20 may include a first coil conductor layer 22 filling the first groove portions 22*h* and protruding onto the upper surface of the support member 21 and a second coil conductor layer 23 filling the second groove portions 23*h* and protruding onto the lower surface of the support member 21. Meanwhile, a via hole 25*h* connecting the first and second groove portions 22*h* and 23*h* to each other may be formed in the support member 21. The via hole 25*h* may be filled with a via conductor layer 25, and the first and second coil conductor layers 22 and 23 may be electrically connected to each other through the via conductor layer 25**.

Generally, a support member disposed between an upper coil and a lower coil in a thin film power inductor is a member required for manufacturing the coil, but includes an insulation resin and is thus a portion unnecessary in terms of characteristics of the coil. In order to reduce this portion, a coreless method, or the like, has been studied in the related art. However, in the coreless method, there is a problem that many processes are changed, and separation of a coil, or the like, may occur in a detaching process . In addition, it may be considered to form a coil using a film for a partition wall. However, in a case of using the film for a partition wall, it is required to develop technology of increasing resolving power of a thicker film in order to further increase an aspect ratio of the coil to a desired level, which is not currently easy.

On the other hand, in the coil component 100 according to the exemplary embodiment, the first and second groove portions **22*h* and 23*h* having planar spiral shapes may be directly formed in the upper and lower surfaces of the support member 21, respectively, and the first and second coil conductor layers 22 and 23 may be formed in the first and second groove portions 22*h* and 23*h* and the upper and lower surfaces of the support member 21, respectively, to form a coil. In this case, since contact cross-sectional areas between the first and second coil conductor layers 22 and 23 and the support member 21 may be increased, rigidity of the first and second coil conductor layers 22 and 23 may be improved, and particularly, a vertical interval between the first and second coil conductor layers 22 and 23 may be decreased. Therefore, even in a case of promoting slimness and thinness of the coil component, a volume occupied by a magnetic material in the body portion 10 may be increased, such that the coil component may have a more excellent inductance. In addition, the first and second coil conductor layers 22 and 23 may fill the first and second groove portions 22*h* and 23*h*, respectively, in some embodiments, but may also protrude on the upper and lower surfaces of the support member 21, respectively, in other embodiments. That is, as a higher partition wall is used in order to increase a protruding height in a manufacturing process, the first and second coil conductor layers 22 and 23** having a higher aspect ratio may be formed. In this case, the coil component may have excellent coil characteristics.

Components of the coil component 100 according to the exemplary embodiment will hereinafter be described in more detail with reference to the drawings.

The body portion 10 may form a basic appearance of the coil component 100. The body portion 10 may have first and second surfaces opposing each other in a first direction, third and fourth surfaces opposing each other in a second direction, and fifth and sixth surfaces opposing each other in a third direction. The body portion 10 may have an approximately hexahedral shape, but is not limited thereto. Six corners at which the first to sixth surfaces meet each other maybe rounded by grinding, or the like.

The body portion 10 may include a magnetic material having a magnetic property. For example, the body portion 10 may be formed by filling ferrite or metal magnetic powders in a resin. The ferrite maybe a material such as Mn—Zn based ferrite, Ni—Zn based ferrite, Ni—Zn—Cu based ferrite, Mn—Mg based ferrite, Ba based ferrite, Li based ferrite, or the like. The metal magnetic powder may include one or more selected from the group consisting of iron (Fe), silicon (Si), chromium (Cr), aluminum (Al), and nickel (Ni). For example, the metal magnetic powder may be a Fe—Si—B—Cr based amorphous metal, but is not necessarily limited thereto.

The magnetic material of the body portion 10 may be a magnetic material-resin composite including metal magnetic powders and an insulation resin. The metal magnetic powders may include iron (Fe), chromium (Cr), or silicon (Si) as main components. For example, the metal magnetic powders may include iron (Fe)-nickel (Ni), iron (Fe), iron (Fe)-chromium (Cr)-silicon (Si), or the like, but are not limited thereto. The insulation resin may include epoxy, polyimide, liquid crystal polymer (LCP), or the like, but is not limited thereto. The metal magnetic powders maybe metal magnetic powders having at least two average particle sizes. Alternatively, the metal magnetic powders may be metal magnetic powders having at least three average particle sizes. In this case, metal magnetic powders having different sizes may be fully filled in the magnetic material-resin composite, such that a packing factor of the magnetic material-resin composite may be increased. Resultantly, an inductance of the coil component 100 may be increased.

The coil portion 20 may include the support member 21, and the first and second groove portions 22h and 23h having the first and second spiral shapes, respectively, may be formed in the upper and lower surfaces of the support member 21, respectively. In addition, the coil portion 20 may include the first coil conductor layer 22 filling the first groove portions 22h and protruding onto the upper surface of the support member 21 and the second coil conductor layer 23 filling the second groove portions 23h and protruding onto the lower surface of the support member 21. Groove portions and a coil conductor layer may be formed in and on only one surface of the support member 21, if necessary, but it may be advantageous in implementing excellent coil characteristics to form the groove portions and the coil conductor layers in and on opposite surfaces of the support member 21. Meanwhile, the via hole 25*h* connecting the first and second groove portions 22*h* and 23*h* to each other may be formed in the support member 21. The via hole 25*h* may be filled with the via conductor layer 25, and the first and second coil conductor layers 22 and 23 may be electrically connected to each other through the via conductor layer 25. In addition, first and second insulating films 26 and 28 covering external surfaces of the first and second coil conductor layers 22 and 23, respectively, may be disposed on the upper and lower surfaces of the support member 21, respectively.

A material or a kind of the support member 21 is not particularly limited as long as the support member 21 may support the first and second coil conductor layers 22 and 23. For example, the support member 21 maybe a copper clad laminate (CCL), an unclad CCL, a polypropylene glycol (PPG) substrate, or the like. That is, the support member 21 may be an insulating substrate formed of an insulating resin. The insulating resin may be a thermosetting resin such as an epoxy resin, a thermoplastic resin such as a polyimide resin, a resin having a reinforcement material such as a glass fiber or an inorganic filler impregnated in the thermosetting resin and the thermoplastic resin, such as prepreg, Ajinomoto build-up film (ABF), or the like. An insulating substrate containing a glass fiber and an epoxy resin may be used as the support member in order to maintain rigidity. However, the support member is not limited thereto.

The coil conductor layers 22 and 23 may allow the coil component 100 to perform various functions through characteristics revealed through the coil. For example, the coil component 100 may be a power inductor. In this case, the coil conductor layers 22 and 23 may serve to store electricity in a magnetic field form to maintain an output voltage, resulting in stabilization of power. The coil conductor layers 22 and 23 may be disposed in the groove portions 22*h* and 23*h* and on the upper and lower surfaces of the support member 21, respectively. The coil conductor layers 22 and 23 may be electrically connected to each other through the via conductor layer 25 formed in the via hole 25*h*.

The coil conductor layers 22 and 23 may include seed layers 22*a* and 23*a* and plating layers 22*b* and 23*b*, respectively. The seed layers 22*a* and 23*a* may be disposed on inner surfaces of the groove portions 22*h* and 23*h* and the upper and lower surfaces of the support member 21, respectively. The plating layers 22*b* and 23*b* may be disposed on the seed layers 22*a* and 23*a*, respectively. Resultantly, the plating layers 22*b* and 23*b* may fill the groove portions 22*h* and 23*h*, respectively, and protrude on the upper and lower surfaces of the support member 21, respectively. All of the seed layers 22*a* and 23*a* and the plating layers 22*b* and 23*b* may be formed by plating, and each of the seed layers 22*a* and 23*a* and the plating layers 22*b* and 23*b* may include a conductive material such as copper (Cu), aluminum (Al), silver (Ag), tin (Sn), gold (Au), nickel (Ni), lead (Pb), titanium (Ti), or alloys thereof. Each of the seed layers 22*a* and 23*a* may have a thickness relatively smaller than that of each of the plating layers 22*b* and 23*b*. Similar to the groove portions 23*h* and 23*h*, the coil conductor layers 22 and 23 may also have planar spiral shapes.

The via conductor layer 25 may include a seed layer 25*a* and a plating layer 25*b*. The seed layer 25*a* may be disposed on an inner surface of the via hole 25*h*. The plating layer 25*b* may be disposed on the seed layer 25*a*. Resultantly, the plating layer 25*b* may fill the via hole 25*h* and electrically connect the coil conductor layers 22 and 23 to each other. The via conductor layer 25 may be formed simultaneously with the coil conductor layers 22 and 23 by plating. Therefore, each layer of the via conductor layer 25 may include a conductive material such as copper (Cu), aluminum (Al), silver (Ag), tin (Sn), gold (Au), nickel (Ni), lead (Pb), titanium (Ti), or alloys thereof. In addition, the seed layer 25*a* may have a thickness relatively smaller than that of the plating layer 25*b*.

The insulating films 26 and 28 may protect the coil conductor layers 22 and 23, respectively. The insulating films 26 and 28 may cover external surfaces of the coil conductor layers 22 and 23, respectively. Any insulating material may be used as a material of each of the insulating films 26 and 28. For example, the material of each of the insulating films 26 and 28 may be an insulating material used for a general insulating coating such as, for example, a thermosetting resin such as an epoxy resin or a polyimide resin, but is not limited thereto.

Meanwhile, an interval W1 between the planar spiral shapes of each of the groove portions 22*h* and 23*h* may be greater than a width W2 of each of the insulating films 26 and 28. For example, the coil component may be more compactly manufactured by significantly decreasing an interval between the coil conductor layers 22 and 23.

In addition, a width W3 of each of the groove portions 22*h* and 23*h* may be greater than a width W4 of the via hole 25*h*. For example, in order to connect the groove portions 22*h* and 23*h* to each other, the via hole 25*h* may be formed at a width smaller than that of each of the groove portions 22*h* and 23*h*. The groove portions 22*h* and 23*h* may be tapered in opposite directions. In this case, the via hole 25*h* may be tapered in the same direction as a direction in which the first groove portion 22*h* is tapered, and may be tapered in an opposite direction to a direction in which the second groove portion 23*h* is tapered. To the contrary, when the via hole 25*h* is formed through the second groove portion 23*h*, the via hole 25*h* may be tapered in an opposite direction to the direction in which the first groove portion 22*h* is tapered, and may be tapered in the same direction to the direction in which the second groove portion 23*h* is tapered.

A through-hole 15 may be formed in a central portion of the coil portion 20, and the magnetic material of the body portion 10 may be disposed in the through-hole 15 to form a magnetic core. That is, central portions of the first and second coil conductor layers 22 and 23 may be connected to each other without being hindered by the support member 21 to form the magnetic core filled with the magnetic material. In this case, inductance characteristics of the coil component may further be improved.

The electrode portion 30 may electrically connect the coil conductor layers 22 and 23 in the coil component 100 to the electronic device when the coil component 100 is mounted in the electronic device, or the like. The electrode portion 30 may include first and second electrodes 31 and 32 disposed, respectively, on the first and second surfaces of the body portion 10 opposing each other in the first direction and partially extending onto the third to sixth surfaces of the body portion 10. The first and second electrodes 31 and 32 may be electrically connected to exposed end portions of the first and second coil conductor layers 22 and 23 on the first and second surfaces of the body portion 10, respectively. However, disposition forms of the first and second electrodes 31 and 32 may also be changed, if necessary. For example, the first and second electrodes 31 and 32 may also be disposed in a lower surface electrode form.

The electrodes 31 and 32 may include conductive resin layers and plating layers formed on the conductive resin layers, respectively. The conductive resin layer may contain one or more conductive metal selected from the group consisting of copper (Cu), nickel (Ni), and silver (Ag), and a thermosetting resin.

The plating layer may contain one or more selected from the group consisting of nickel (Ni), copper (Cu), and tin (Sn). For example, a nickel (Ni) layer and a tin (Sn) layer may be sequentially formed in the plating layer. However, the electrodes are not limited thereto. For example, a sequence of these layers may also be changed.

Figure 4:
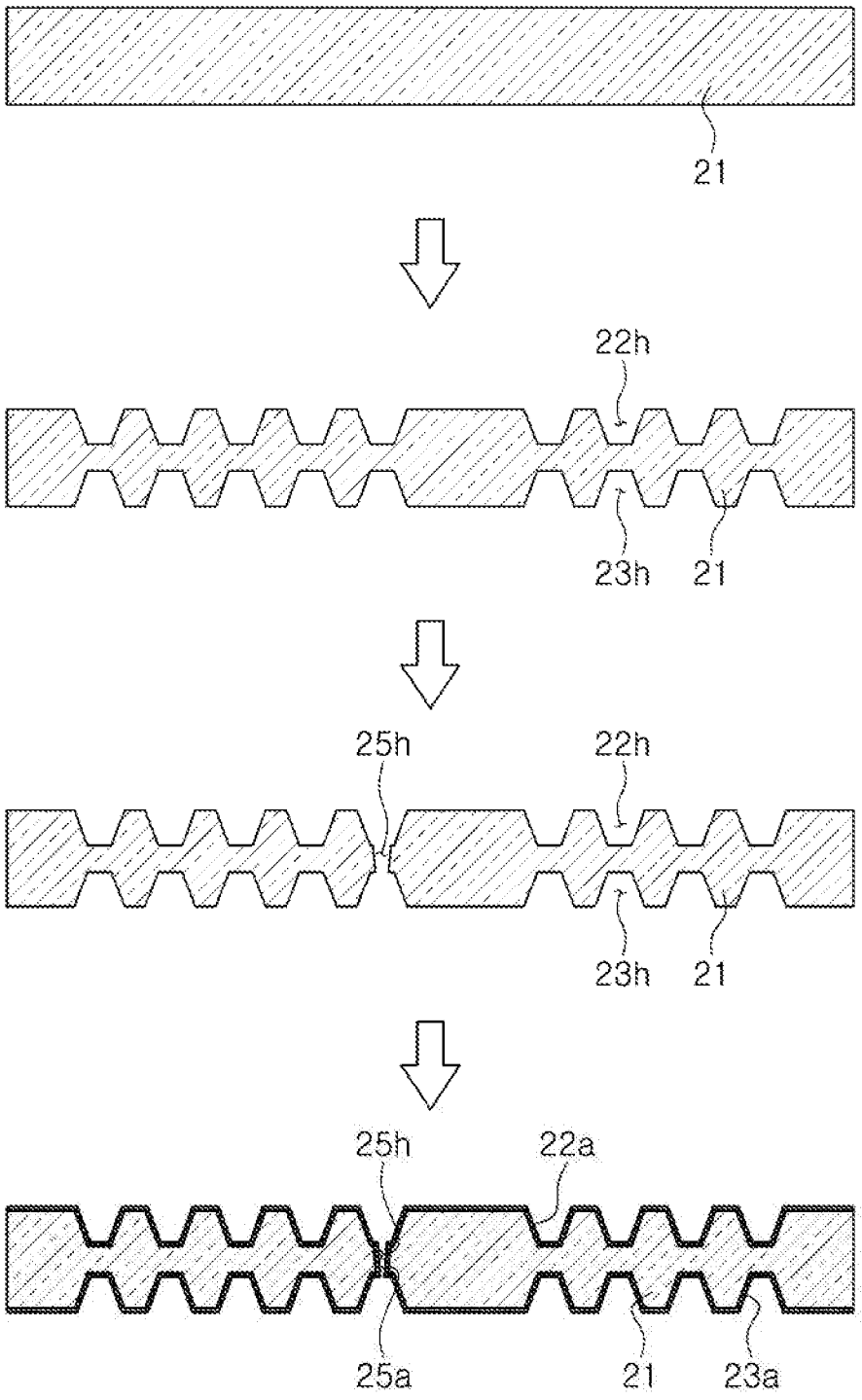
FIGS. 4 through 6 are schematic views sequentially illustrating processes of manufacturing a coil component.
Figure 5:
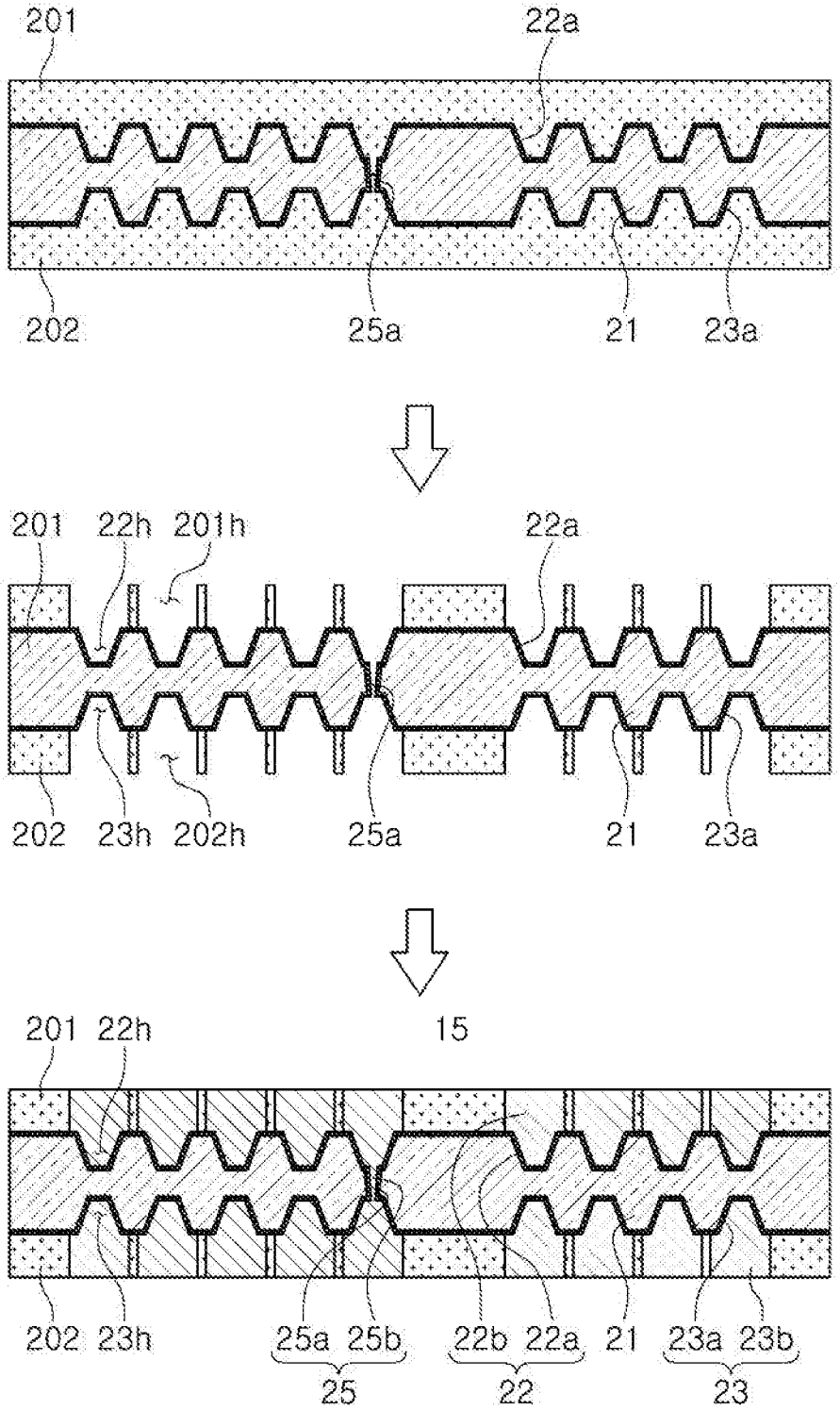
Figure 6:
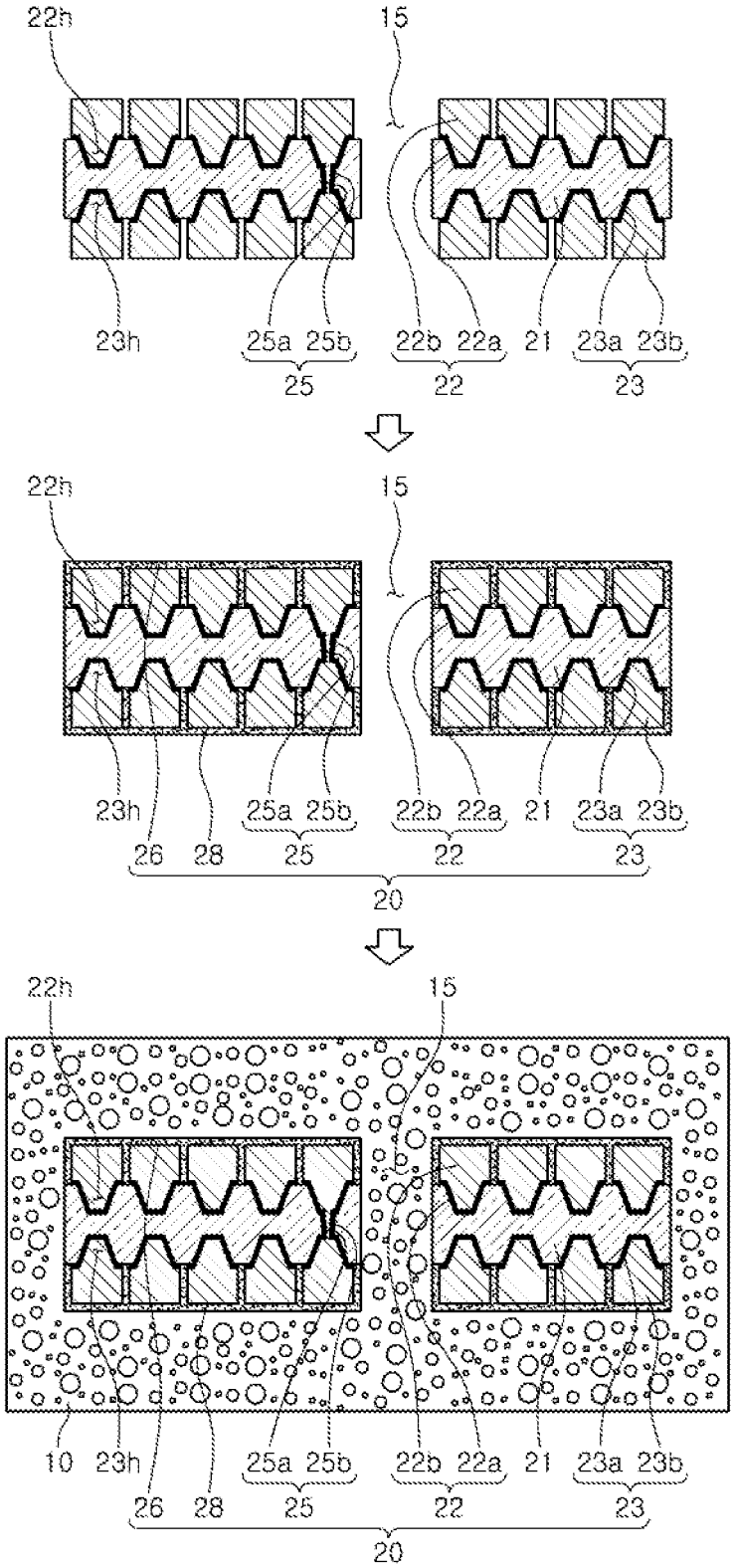

FIGS. 4 through 6 are schematic views sequentially illustrating processes of manufacturing a coil component.

Referring to FIG. 4, the support member 21 may be first prepared. The unclad CCL, or the like, may be used as the support member 21, as described above. Then, the first and second groove portions 22*h* and 23*h* may be formed in the upper and lower surfaces of the support member 21, respectively, so as to have the first and second planar spiral shapes, respectively. The groove portions 22*h* and 23*h* may be formed by a laser drill, a mechanical drill, or a sandblaster, or the like. Alternatively, the groove portions 22*h* and 23*h* may be formed by vacuum-compressing the support member 21 to a trench structure . Next, the via hole 25*h* connecting specific points of the first and second groove portions 22*h* and 23*h* to each other may be formed. The via hole 25*h* may also be formed by a laser drill, a mechanical drill, or a sandblaster, or the like. Alternatively, the via hole 25*h* may be formed by vacuum-compressing the support member 21 to a trench structure. If necessary, the via hole 25*h* may be first formed, and the groove portions 22*h* and 23*h* may be formed subsequently. Then, the seed layers 22*a*, 23*a*, and 25*a* may be formed by any known plating process such as sputtering.

Then, referring to FIG. 5, dry films 201 and 202 may be laminated on the upper and lower surfaces of the support member 21, respectively. The dry films 201 and 202 may be any known photosensitive films for which a photolithography method may be used. Then, patterns 201*h* and 202*h* having planar spiral shapes may be formed in the dry films 201 and 202, respectively, so that the groove portions 22*h* and 23*h* are exposed. The patterns 201*h* and 202*h* may be formed by a photolithography method such as exposure, development, and the like. Then, the plating layers 22*b*, 23*b*, and 25*b* may be formed by any known plating process such as electroplating or electroless plating using the dry films 201 and 202 as partition walls to form the coil conductor layers 22 and 23 and the via conductor layer 25.

Then, referring to FIG. 6, the through-hole 15 penetrating through the central portion of the support member 21 may be formed. The through-hole 15 may be formed by a laser drill and/or a mechanical drill. Then, an insulating material may be applied to the upper and lower surfaces of the support member 21 by a screen printing method, a process through exposure/development of a photoresist (PR), a spray applying process, or the like, to form the insulating films 26 and 28 covering the external surfaces of the coil conductor layers 22 and 23, respectively. Then, the body portion 10 may be formed by laminating magnetic sheets on and beneath of the support member 21. The magnetic sheets may be manufactured in a sheet shape by mixing metal magnetic powders, an insulating resin, and organic materials such as a solvent, and the like, with one another to prepare slurry, applying the slurry at a thickness of several ten micrometers onto carrier films by a doctor blade method, and then drying the applied slurry. Then, although not illustrated, the first and second electrodes 31 and 32 at least covering the first and second surfaces of the body portion 10, respectively, may be formed so as to be connected, respectively, to the end portions of the first and second coil conductor layers 22 and 23 each led to the first and second surfaces of the body portion 10. The electrodes 31 and 32 may be formed of a paste including a metal having excellent electrical conductivity, and may be formed by, for example, a method of printing a conductive paste including nickel (Ni), copper (Cu), tin (Sn), or silver (Ag), or alloys thereof . After the conductive paste is printed, a plating layer may further be formed. The plating layer may include one or more selected from the group consisting of nickel (Ni), copper (Cu), and tin (Sn) . For example, a nickel (Ni) layer and a tin (Sn) layer may be sequentially formed in the plating layer. Other processes such as dicing, electroplating measurement, taping, and the like, may be performed in required sequences to manufacture the coil component 100 according to the exemplary embodiment.

Figure 7A:
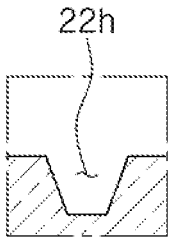
FIGS. 7A through 7C are schematic views illustrating various cross-sectional shapes of a groove portion formed in a support member.
Figure 7B:
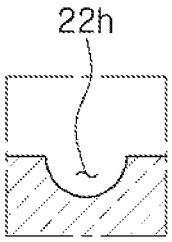
Figure 7C:
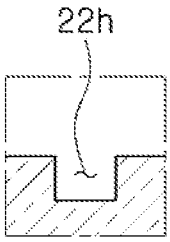

FIGS. 7A through 7C are schematic views illustrating various cross-sectional shapes of a groove portion formed in a support member.

Referring to FIGS. 7A through 7C, a shape of a cross section of the groove portion 22*h* may be a trapezoidal shape, a semicircular shape, or a rectangular shape, but is not limited thereto. Although not illustrated, a shape of a cross section of the groove portion 23*h* may also be a trapezoidal shape, a semicircular shape, or a rectangular shape, but is not limited thereto.

As set forth above, according to the exemplary embodiment in the present disclosure, the coil component capable of being used in a miniaturized device and having high performance and reliability, and the method of manufacturing the same may be provided.

While exemplary embodiments have been shown and described above, it will be apparent to those skilled in the art that modifications and variations could be made without departing from the scope of the present invention as defined by the appended claims.

What is claimed is:

1. A coil component comprising:

a body portion including a magnetic material;

a coil portion disposed in the body portion; and an electrode portion disposed on the body portion, wherein the coil portion includes a support member having groove portions formed in at least one surface thereof and a coil conductor layer filling the groove portions and protruding onto the at least one surface such that at least a portion of the coil conductor layer extends continuously from inside the groove portions onto the at least one surface, the groove portions having planar spiral shapes, wherein the coil conductor layer has a variable line width inside the groove portions and a substantially constant line width outside the groove portions, and wherein the substantially constant line width is wider than a widest portion of the variable line width.

2. The coil component of claim 1, wherein the coil conductor layer is a plurality of conductor layers including a seed layer disposed in the groove portions and on the one surface and a plating layer disposed on the seed layer.

3. The coil component of claim 1, wherein the coil portion further includes an insulating film disposed on the at least one surface of the support member and covering an external surface of the coil conductor layer.

4. The coil component of claim 3, wherein an interval between the planar spiral shapes of the groove portions is greater than a width of the insulating film.

5. The coil component of claim 1, wherein a shape of a cross section of the groove portion is trapezoidal, semicircular, or rectangular.

6. The coil component of claim 1, wherein the support member includes first groove portions formed in an upper surface of the support member and having a first planar spiral shape and second groove portions formed in a lower surface of the support member and having a second planar spiral shape, as the groove portions, and the coil conductor layer includes a first coil conductor layer filling the first groove portions and protruding onto the upper surface of the support member and a second coil conductor layer filling the second groove portions and protruding onto the lower surface of the support member.

7. The coil component of claim 6, wherein a via hole connecting the first and second groove portions to each other is formed in the support member, the via hole is filled with a via conductor layer, and the first and second coil conductor layers are connected to each other through the via conductor layer.

8. The coil component of claim 7, wherein a width of each of the first and second groove portions is greater than that of the via hole.

9. The coil component of claim 7, wherein the first and second groove portions are tapered in opposite directions, and the via hole is tapered in the same direction as a direction in which one of the first and second groove portions is tapered.

10. The coil component of claim 6, wherein the first coil conductor layer is exposed through one end surface of the body portion, the second coil conductor layer is exposed through the other end portion of the body portion, and the electrode portion includes first and second electrodes disposed on the one end portion and the other end surface of the body portion, respectively, and connected to exposed end portions of the first and second coil conductor layers, respectively.

11. The coil component of claim 1, wherein a through-hole is formed in a central region of the coil portion, and the through-hole is filled with the magnetic material of the body portion.

12. The coil component of claim 11, wherein the magnetic material includes a plurality of magnetic particles having different average particle sizes.

13. A coil component comprising:

an insulating support member having a spiral groove formed in a first surface of the insulating support member;

a coil conductor disposed in the spiral groove of the insulating support member to form a coil portion, the coil conductor filling the spiral groove and protruding onto the first surface such that at least a portion of the coil conductor extends continuously from inside the spiral groove onto the first surface; and a body including a magnetic material, the coil portion being disposed in the body, wherein the coil conductor has a variable line width inside the spiral groove and a substantially constant line width outside the spiral groove, and wherein the substantially constant line width is wider than a widest portion of the variable line width.

14. The coil component of claim 13, wherein the coil conductor comprises a seed layer disposed on a surface of the spiral groove and a plating layer disposed on the seed layer.

15. The coil component of claim 13, further comprising an insulating film disposed on the support member and covering an external surface of the coil conductor.

16. The coil component of claim 13, wherein a shape of a cross section of the spiral groove is trapezoidal, semicircular, or rectangular.

17. The coil component of claim 13, wherein the insulating support member has a second spiral groove in a second surface opposing the first surface, a second coil conductor is disposed in the second spiral groove, the second coil conductor filling the second spiral groove and protruding onto the second surface, a via hole filled with a via conductor is formed in the insulating support member, and the via conductor physically and electrically connects the coil conductor and the second coil conductor.

* * * * *